US011319725B2

(12) United States Patent
Chen

(10) Patent No.: US 11,319,725 B2
(45) Date of Patent: May 3, 2022

(54) SWINGSET FRAME SHADE

(71) Applicant: Samuel Chen, Causeway Bay (HK)

(72) Inventor: Samuel Chen, Causeway Bay (HK)

( * ) Notice: Subject to any disclaimer, the term of this patent is extended or adjusted under 35 U.S.C. 154(b) by 124 days.

(21) Appl. No.: 16/937,930

(22) Filed: Jul. 24, 2020

(65) Prior Publication Data

US 2022/0022613 A1 Jan. 27, 2022

(51) Int. Cl.

| | |
|---|---|
| ***E04H 15/02*** | (2006.01) |
| ***A63G 9/00*** | (2006.01) |
| *A45B 11/00* | (2006.01) |
| *A45B 19/00* | (2006.01) |
| *A45B 19/06* | (2006.01) |
| *A47C 7/66* | (2006.01) |

(52) U.S. Cl.

CPC ..... *E04H 15/02* (2013.01); *A63G 9/00* (2013.01); *A45B 11/00* (2013.01); *A45B 19/06* (2013.01); *A45B 2019/005* (2013.01); *A47C 7/66* (2013.01)

(58) Field of Classification Search

None

See application file for complete search history.

(56) References Cited

U.S. PATENT DOCUMENTS 352,842 A * 11/1886 Stevens ..... A45F 3/24 5/127
638,174 A * 11/1899 Diggins ..... A45F 3/24 5/128
2,353,220 A * 7/1944 Charlop ..... A45F 3/24 5/128
2,546,350 A * 3/1951 Spangler ..... A45F 3/24 248/163.2
4,757,563 A * 7/1988 An ..... A45F 3/24 5/128
4,825,890 A * 5/1989 Castlebury ..... E04H 15/58 482/37
4,898,198 A 2/1990 Castlebury
6,383,085 B1 * 5/2002 Tseng ..... A47C 7/66 5/128
6,802,328 B2 10/2004 Lin
8,715,095 B2 5/2014 Hsieh
8,753,216 B2 6/2014 Hsieh
(Continued)

FOREIGN PATENT DOCUMENTS

DE 202004017324 U1 * 3/2005 ..... A47C 3/025
WO WO-2016125995 A1 * 8/2016 ..... A45F 3/22

*Primary Examiner* — David R Dunn
*Assistant Examiner* — Danielle Jackson
(74) *Attorney, Agent, or Firm* — Clement Cheng

(57) ABSTRACT

A swingset frame shade has a canopy top. The canopy top is bounded by and has a canopy front support, a canopy rear support, a canopy right upper support, and a canopy left upper support. A right panel is connected to the canopy top at a canopy right upper support. A extends canopy right front support extending downwardly from the canopy right upper support and a canopy right rear support extends downwardly from the canopy right upper support. The canopy right front support and the canopy right rear support join together at a right lower tip. A left panel connects to the canopy top at a canopy left upper support. A canopy left front support extends downwardly from the canopy left upper support and a canopy left rear support extends downwardly from the canopy left upper support.

16 Claims, 5 Drawing Sheets

(56) References Cited

U.S. PATENT DOCUMENTS

| | | | | |
|---|---|---|---|---|
| 8,783,329 | B2 | 7/2014 | Hsieh | |
| 9,038,694 | B2 * | 5/2015 | Hsieh | E04F 10/02 135/90 |

* cited by examiner

SWINGSET FRAME SHADE

FIELD OF THE INVENTION

The present invention is in the field of swingset frame shades.

DISCUSSION OF RELATED ART

A variety of prior art references describe various structures for a swing set frame shade. For example, in U.S. Pat. No. 8,715,095 entitled Outdoor Playground With Shading Apparatus by inventor Paul Hsieh published May 6, 2014 the abstract discloses, "An outdoor playground includes a first and a second entertainment units connected with each other. The first entertainment unit includes a first utility frame configured to allow a predetermine entertainment function to be carried out by the first utility frame and a first shading apparatus detachably mounted on the first utility frame for effectively shielding the first utility frame. The second entertainment unit includes a second utility frame configured to allow a predetermine entertainment function to be carried out by the second utility frame, and a second shading apparatus detachably mounted on the second utility frame for effectively shielding the second utility frame so as to allow the entertainment function to be carried out under shading."

Also for example, in U.S. Pat. No. 4,898,198 entitled Canopy Apparatus For Children's Swings by inventor Gerald E. Castlebury published Feb. 6, 1990 the abstract discloses, "A canopy apparatus (10) for conventional A-frame swing constructions (100) wherein the canopy apparatus (10) comprises a pair of support units (11) operatively connected to the horizontal support bar (103) of the swing set (100) and a cover unit (12) operatively attached to and suspended from the pair of support units (11)."

Also for example, in U.S. Pat. No. 6,802,328 entitled Adjustable Canopy of a Swing Set by inventor Steve Lin published Oct. 10, 2004 the abstract discloses, "An adjustment device of an adjustable canopy of a swing set includes a fixed part, an engaging part, and an adjustable part. The fixed part is joined to the frame of a swing set, and has locating hooks. The engaging part is securely connected to the fixed part, and has engaging protrusions on an outer side, which have convexly curved surfaces, and plasticity. The adjustable part, to which a covering part of the canopy is connected, has concavely curved sections spaced around an annular inner side. The locating hooks are connected to the adjustable part such that the adjustable part can turn relative to the fixed part. The concavely curved portions contact the convexly curved protrusions. The inner side of the adjustable part depresses the convexly curved protrusions when force is exerted on the adjustable part so that the canopy covering part can be adjusted."

Also for example, in U.S. Pat. No. 8,753,216 entitled Mist Producing Device for Playground with Sun Shade Apparatus by inventor Paul Hsieh published Jun. 17, 2014 the abstract discloses, "A play set with a mist device which includes a mist frame unit supported through a framework of the play set. The mist frame unit has a hollow body allowing water passage and comprises a flexible hose member mounted onto the framework, wherein a portion of the flexible hose member is constructed into a hose ring encircling a slide unit; a water inlet provided at a first end of the mist frame unit for connecting to a water source; and a plurality of mist producing units provided along the mist frame unit arranged for producing mist such that a preset mist surrounding area is defined within which the play set is located, therefore the mist can reach all play units of the play set, including the slide unit through the hose ring at an angle which is greater than 270°, thereby providing a cooling effect to the mist surrounding area."

Also for example, in U.S. Pat. No. 8,783,329 entitled Sun Shade Apparatus by inventor Paul Hsieh published Jul. 22, 2014 the abstract discloses, "A sun shading apparatus includes a supporting frame, a shading frame and a shading fabric. The supporting frame includes first and second leg frames, and a supporting bar extended between the first and the second leg frames, while the second leg frame has third and fourth mounting slots. The shading frame includes first and second coupling joints each having a V-shaped cross section, first and second frame members, and a reinforcing frame, wherein the supporting bar is extended between the first and second coupling joints. The first and the second frame member are coupled with the first coupling joint and the second coupling joint respectively, while the reinforcing frame is extended between the first and second frame member and the supporting bar to form a support platform. The shading fabric is detachably mounted on the support platform for shading adverse weather condition."

SUMMARY OF THE INVENTION

A swingset frame shade has a canopy top. The canopy top is bounded by and has a canopy front support, a canopy rear support, a canopy right upper support, and a canopy left upper support. A right panel is connected to the canopy top at a canopy right upper support. A extends canopy right front support extending downwardly from the canopy right upper support and a canopy right rear support extends downwardly from the canopy right upper support. The canopy right front support and the canopy right rear support join together at a right lower tip. A left panel connects to the canopy top at a canopy left upper support. A canopy left front support extends downwardly from the canopy left upper support and a canopy left rear support extends downwardly from the canopy left upper support. The canopy left front support and the canopy left rear support join at a left lower tip.

A canopy left front line and a canopy left rear line support the canopy top. The canopy left front line is connected to the left front canopy corner. The canopy left front support connects to the canopy left upper support. The canopy left rear line is connected to the left rear canopy corner. The canopy left upper support is connected to the canopy left rear support.

The right panel is formed in a right triangular shape. The canopy right front support, the canopy right rear support, and the canopy right upper support are formed as flexible rods arranged along the edges of the right triangular shape. The right lower tip, the right front canopy corner, and the right rear canopy corner form vertices of the right triangular shape.

The right front canopy corner is connected to a canopy right front line, and the right rear canopy corner is connected to a canopy right rear line. The left panel is formed in a left triangular shape, and the canopy left front support, the canopy right left support, and the canopy left upper support are formed as flexible rods arranged along the edges of the left triangular shape. The left lower tip, the left front canopy corner, and the left rear canopy corner form vertices of the left triangular shape. The left front canopy corner is connected to a canopy left front line, the left rear canopy corner is connected to a canopy left rear line. The canopy top has a top right sleeve receiving the canopy right upper support, and the canopy top has a top left sleeve receiving the canopy left upper support. The canopy right upper support is retained between a front right pocket formed at the right front canopy corner and a rear right pocket formed at the right rear canopy corner. The canopy left upper support is retained between a front left pocket formed at the left front canopy corner and a rear left pocket formed at the left rear canopy corner.

The canopy top with the right panel and the left panel is mounted to a swingset frame. The swingset frame further includes a top horizontal frame support. The top horizontal frame support has a left apex connection and a right apex connection. A front left diagonal support and a rear left diagonal support connect together at the left apex connection. A front right diagonal support and a rear right diagonal support connect together at the right apex connection. A right horizontal support connects between the front right diagonal support and the rear right diagonal support. A left horizontal support connects between the front left diagnosed support and the rear left diagonal support.

For improved reinforcement and stability, upgraded hardware can provide more robust structure. The canopy right upper support and the canopy left upper support are optionally formed as telescopic rods. The canopy right upper support and the canopy left upper support are formed as metal telescopic rods having coaxial translational mechanical engagement. The canopy left front line and the canopy left rear line are formed as rods.

Figure 1:
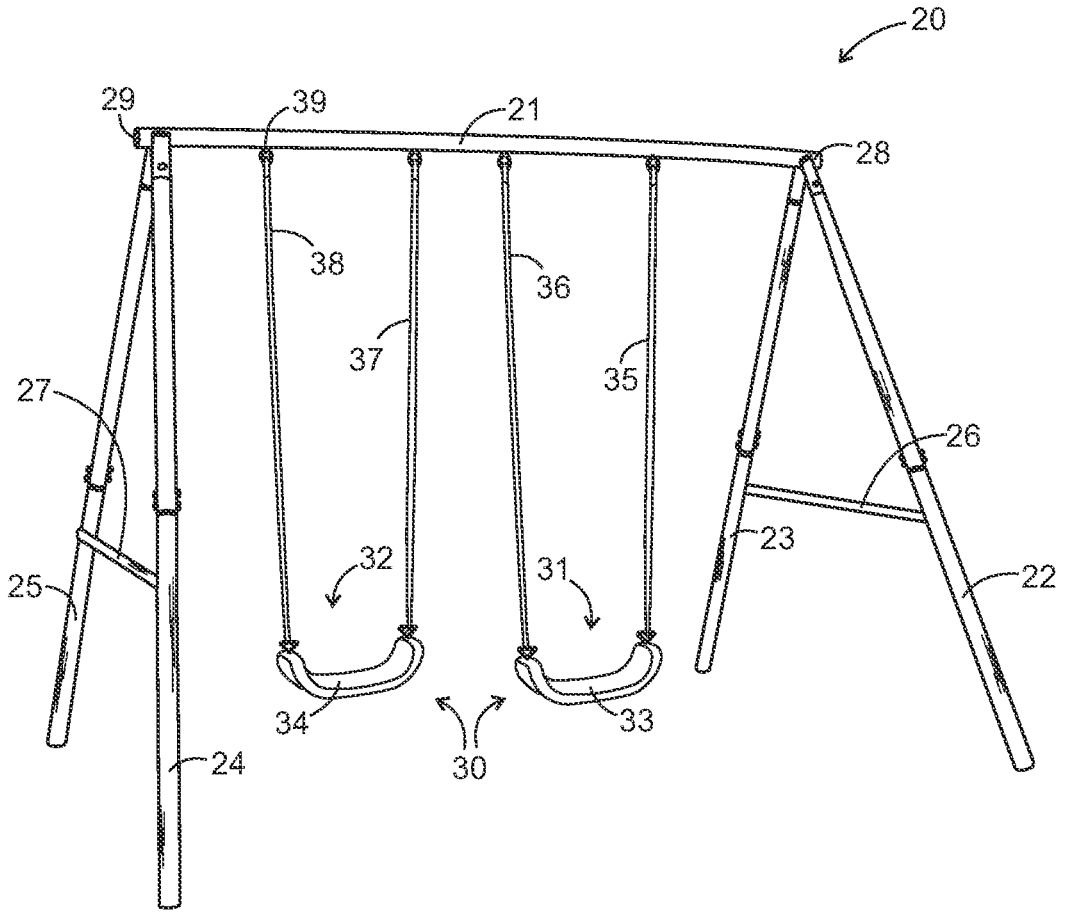
FIG. 1 is a diagram of a swing set having an A-frame structure.

The following call out list of elements can be a useful guide for referencing the element numbers of the drawings.

20 frame
21 top horizontal frame support
22 front right diagonal support
23 rear right diagonal support
24 front left diagonal support
25 rear left diagonal support
26 right horizontal support
27 left horizontal support
28 right apex connection
29 left apex connection
30 swings
31 right swing
32 left swing
33 right swing seat
34 left swing seat
35 right swing right chain
36 right swing left chain
37 left swing right chain
38 left swing left chain
39 swing connection
40 canopy
41 canopy top
42 canopy front support
43 canopy rear support
44 canopy right upper support
45 canopy left upper support
46 canopy right front support
47 canopy right rear support
48 canopy left front support
49 canopy left rear support
50 canopy line connection system
51 right panel
52 left panel
53 canopy right front line
54 canopy left front line
55 canopy right rear line
56 canopy left rear line
57 right panel lower line
58 left panel lower line
59 canopy edge
61 collar connector
62 hook connector
63 edge retainer hook
64 swivel joint
65 telescoping mechanism
66 rotating rod
67 collar set screw
68 frame bolt
69 soldiered -on ring
71 front right pocket
72 front left pocket
73 rear right pocket
74 rear left pocket
75 top right sleeve
76 top left sleeve
77 first top strap
78 second top strap
80 buckle
81 right lower tip
82 left lower tip
83 left front canopy corner
84 left rear canopy corner
85 right front canopy corner
86 right rear canopy corner
87 right triangular shape
88 left triangular shape
90 pull strap end
91 buckle slot
92 fabric strap

DETAILED DESCRIPTION OF THE PREFERRED EMBODIMENT

As seen in FIG. 1, the present invention begins with a frame 20 a swing set. The users swing on the swings and often need shade. However, not all swing sets come with a shade. Accordingly, the present invention fits over the swingset frame 20.

A frame 20 has a top horizontal frame support 21. At a right apex connection 28, the top horizontal frame support 21 connects to a top portion of a front right diagonal support 22 and a rear right diagonal support 23. At a left apex connection 29, the top horizontal frame support 21 connects to a top portion of a rear left diagonal support 25, and a front left diagonal support 24. A right horizontal support 26 extends between the front right diagonal support 22 and the rear right diagonal support 23. A left horizontal support 27 extends between a front left diagonal support 24 and a rear left diagonal support 25.

A pair of swings 30 can be suspended from the top horizontal frame support 21. A right swing 31 has a right swing seat 33. The right swing seat 33 is supported at a right swing right chain 35 and a right swing left chain 36. Similarly, a left swing 32 can have a left swing seat 34. The left swing seat 34 has a left swing right chain 37 and a left swing left chain 38. A swing connection 39 connects the swing chains to the top horizontal frame support 21. The swing connection 39 can be a threaded bolt having an eyelet that threads to a threaded opening of the top horizontal frame support 21.

Figure 2:
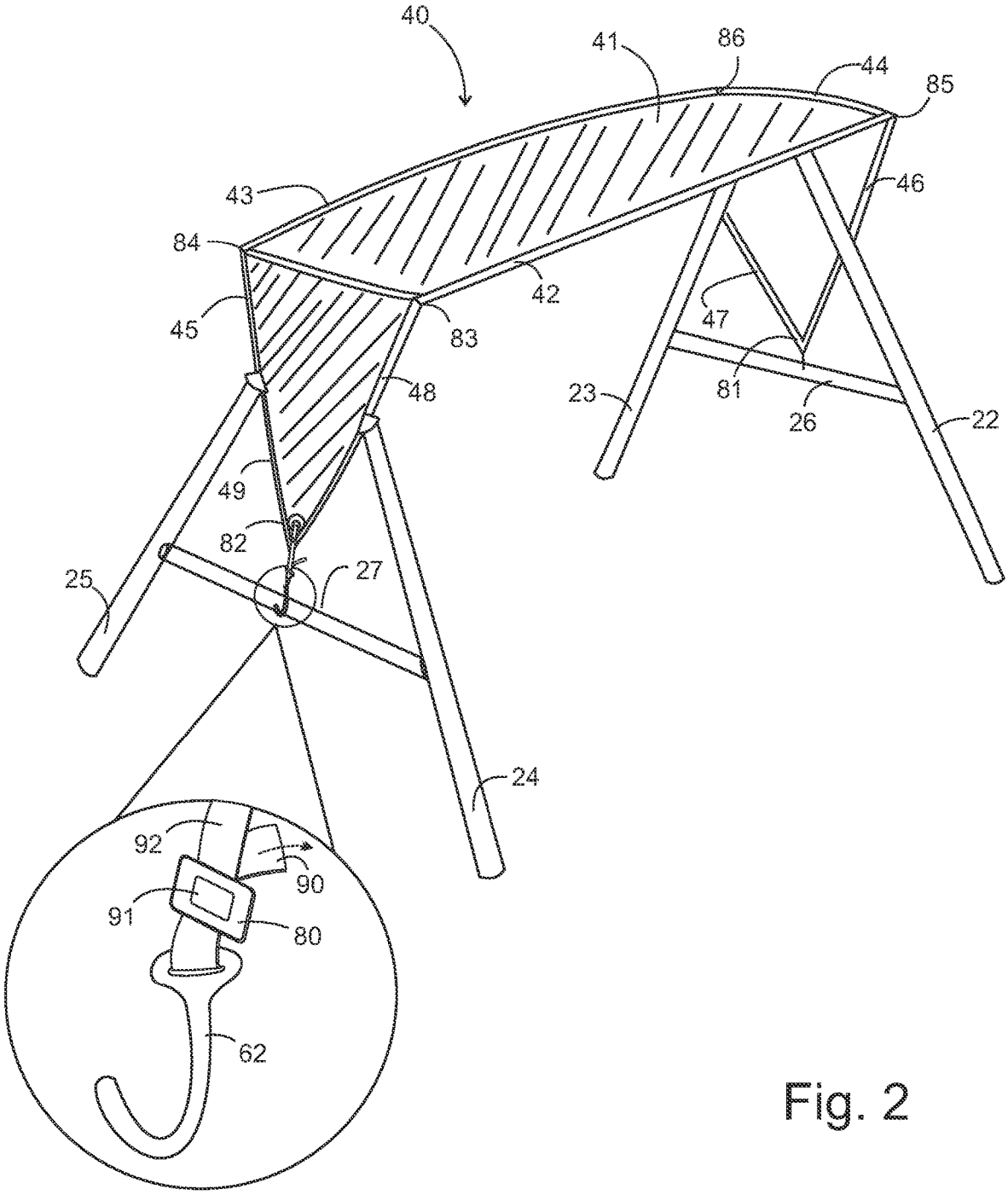
FIG. 2 is a diagram of the present invention swingset frame shade attached to the swingset frame.

As seen in FIG. 2, a canopy 40 can be installed to the frame 20. The canopy 40 has a canopy top 41 shown as a generally rectangular sheet of fabric. The canopy top 41 has a canopy front support 42, a canopy rear support 43, a canopy right upper support 44, and a canopy left upper support 45. The canopy right upper support 44 and the canopy left upper support 45 can be made of fiberglass rods fit into sleeves or attached by a hook and loop tape straps to the canopy top 41. The canopy top 41 is formed as a panel of fabric such as a woven plastic polymer fabric. The canopy top 41 preferably has ultraviolet resistance impregnated in the fabric of the canopy top 41. The canopy front support 42 and the canopy rear support 43 can be an elongated elastic cord suspended in tension, or can be a fiberglass rod made of multiple sections. When the lengthwise dimension of the canopy is made adjustable, the canopy front support 42 and the canopy rear support 43 are preferably made of elastic cord.

The embodiment as seen in FIG. 2 has a pair of triangular panels. Each triangular end panel has three sides and three vertices. Each of the three vertices is a distal point which is a tip. Each of the sides is attached to a fiberglass rod such as by straps, or by a sleeve. The fiberglass rods can be made in a tent pole style construction with the vertex connections as a pair of pockets for receiving the ends of the fiberglass rods. The pair of pockets can be arranged with pocket openings at 60° angle to each other. In this way, the canopy top 41 can be supported by the pair of triangular side panels. The canopy front and rear supports can be angled at 60° to each other, and preferably have a midpoint strapped to the diagonal supports of the swingset frame. The canopy right front line 53 secures to the front right diagonal support 22. The canopy right rear line 55 secures to the right rear diagonal support 23. The canopy left front line 54 secures to the front left diagonal support 24. The canopy left rear line 56 secures to the rear left diagonal support 25. The left and right panels also have a lower line that connects to the horizontal supports of the swingset frame.

More specifically, the canopy left front support 48 can be connected to the front left diagonal support 24. The canopy left rear support 49 can be connected to the rear left diagonal support 25. The canopy right front support 46 can be connected to the front right diagonal support 22. The canopy right rear support 47 can be connected to the rear right diagonal support 23. The right horizontal support 26 preferably connects to a right tip of the canopy. The left horizontal support 27 preferably connects to a left tip of the canopy. The canopy has a rectangular canopy top 41 and a pair of triangular panels on each side. Each of the triangular panels has a vertex at a distal portion of the triangular panel. Each distal point is a tip.

The canopy top 41 has four corners including a left front canopy corner 83, a left rear canopy corner 84, a right front canopy corner 85, and a right rear canopy corner 86. The canopy left upper support 45 has a pair of ends that terminate at the left front canopy corner 83 and the left rear canopy corner 84. The canopy right upper support 44 has a pair of ends that terminate at the right front canopy corner 85 and the right rear canopy corner 86. The left triangular panel is defined by three vertices of the left triangle which are the left lower tip 82, the left front canopy corner 83, and the left rear canopy corner 84. The right triangular panel is defined by three vertices of the right triangle which are the right lower tip 81, the right front canopy corner 85, and the right rear canopy corner 86. The right front canopy corner 85 and the right rear canopy corner 86 are at the same height which are both mounted above the right lower tip 81. The left front canopy corner 83 and the left rear canopy corner 84 are at the same heights which are both mounted above the left lower tip 82. The right triangular panel has a right triangular shape 87, and the left triangular panel has a left triangular shape 88.

The lower tips of the triangular panels can receive a grommet with a strap or line through the grommet or instead of a grommet at the top, nylon woven fabric strap can be stretched to the lower tip. The fabric strap or line preferably has a length and tension adjustment using a pair of buckles 80. The free ends of the fabric strap or line can be retained by the buckles 80 which are sliding mounted on the fabric strap or line. The buckles 80 can have an upper opening and a lower opening. In the case of a fabric strap buckle, the upper opening and a lower opening can be formed as buckle slots 91. The fabric strap 92 can end at a pull strap end 90. A user pulls on the pull strap end 90 to tighten the fabric strap 92 on the buckle slots 91 at the buckle 80. Pulling on the pull strap tightens the fabric strap 92 on the buckle slots 91 at the buckle 80.

Figure 3:
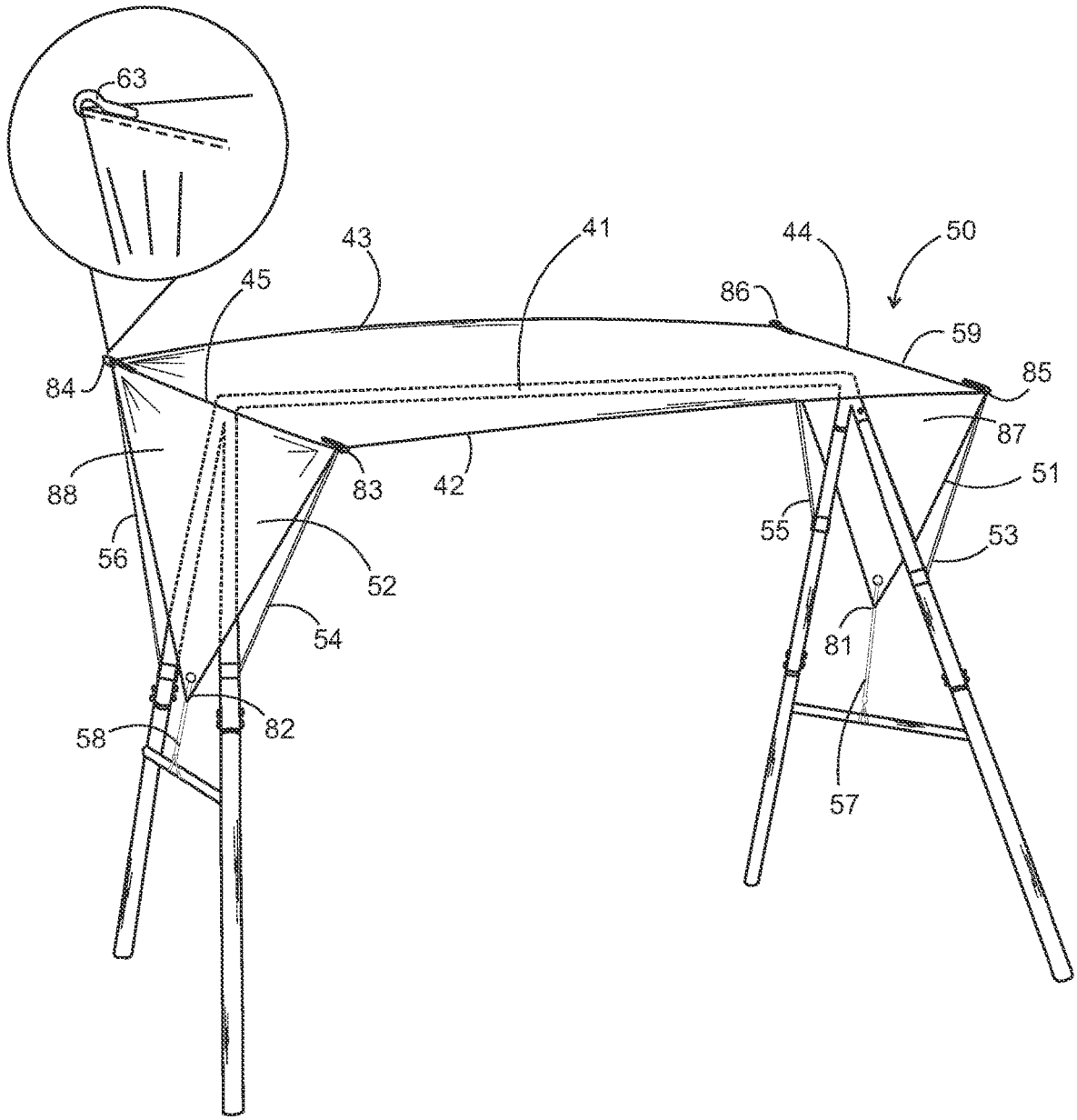
FIG. 3 is a diagram of the present invention showing connection of the swingset frame shade to the swingset frame.

As seen in FIG. 3, a right panel lower line 57 can connect a right lower tip 81 to the right horizontal support 26, and a left panel lower line 58 can connect a left lower tip 82 to the left horizontal support 27.

The canopy top 41 including the canopy front support 42, the canopy rear support 43, the canopy right upper support 44, and the canopy left upper support 45 are flexible and secure to the frame 20 with a canopy line connection system 50. The right panel 51 is formed as a triangle and extends from the rectangular canopy top 41. The right panel 51 has a canopy right front line 53, and a canopy right rear line 55. The canopy right front line 53 secures to the front right diagonal support 22. The canopy right rear line 55 secures to the right rear diagonal support 23. The canopy left front line 54 secures to the front left diagonal support 24. The canopy left rear line 56 secures to the rear left diagonal support 25.

The canopy side edge 59 is formed at a junction of the right panel 51 and the canopy top 41 along the canopy right upper support 44. Similarly, the canopy side edge 59 is formed at a junction of the left panel 52 and the canopy top 41 along the canopy left upper support 45. Accordingly, the canopy has a canopy right side edge and a canopy left side edge. An edge retainer lock 63 can be formed as a hook for retaining fabric along the canopy edge 59. The edge retainer lock 63 is preferably formed as a clip that can extend from the canopy right upper support 44 or the canopy left upper support 45. If the canopy right upper support 44 and the canopy left upper support 45 are formed as rods, the retainer lock 63 can be a socketed member fitting to an end of the rod. The retainer lock 63 could also be clipped to the end of the rod rather than socketed to the end of the rod.

Figure 4:
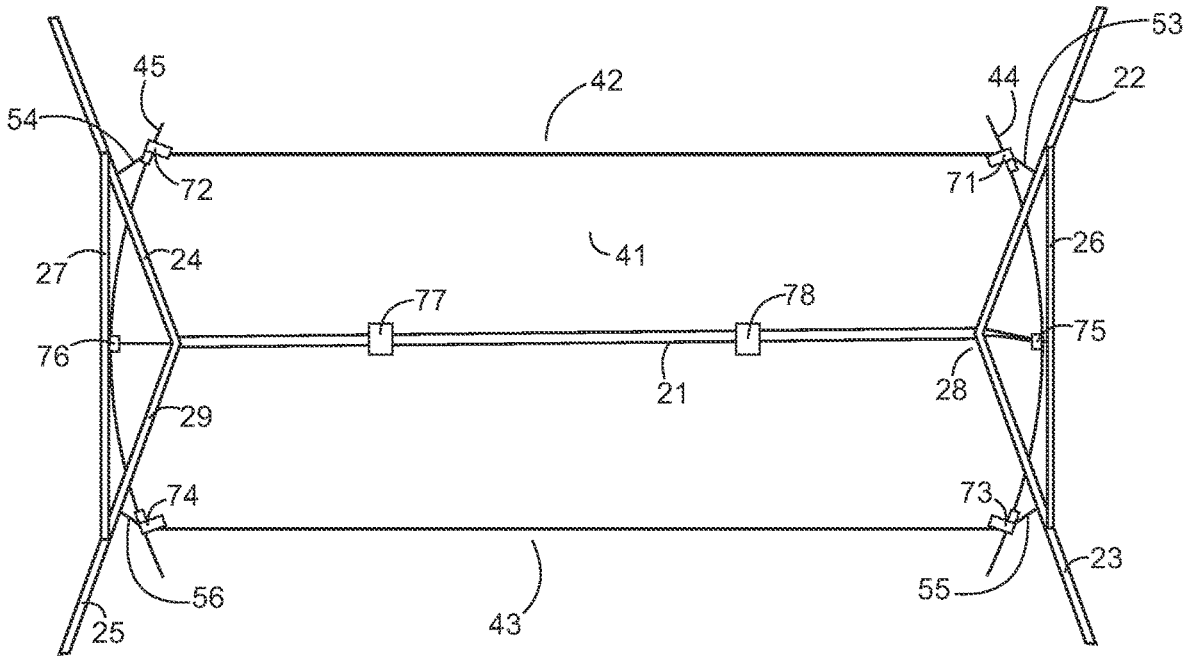
FIG. 4 is a lower view diagram of the present invention.

As seen in FIG. 4, a lower view shows that the frame supports the canopy top 41. A first top strap 77 and a second top strap 78 can be stitched to the canopy top 41 and strapped around the top horizontal frame support 21. The fiberglass rods forming the canopy right upper support 44 and the canopy left upper support 45 can be pocketed or strapped to the canopy top 41. The canopy right upper support 44 can be pocketed to the canopy top 41 at a front right pocket 71, and a rear right pocket 73. The canopy left upper support 45 can be pocketed to the canopy top 41 at a front left pocket 72 and a rear left pocket 74. Preferably, a top right sleeve 75 can be formed as a hook and loop tape strap sleeve, or a strap pair with a buckle. The top right sleeve 75 can be stitched to the canopy top 41 and secure the canopy top 41 to the canopy right upper support 44. Similarly, a top left sleeve 76 can be stitched to the canopy top 41 and secure the canopy top 41 to the canopy left upper support 45. The top left sleeve 76 can also be made as a hook and loop tape strap sleeve, or a strap pair with a buckle. The top right sleeve 75 and the top left sleeve 76 could also be made as stitched loops which would require a user to insert the fiberglass rod through the loops during assembly.

Again the canopy line connections secure the canopy to the frame. The canopy right front line 53 secures to the front right diagonal support 22. The canopy right rear line 55 secures to the right rear diagonal support 23. The canopy left front line 54 secures to the front left diagonal support 24. The canopy left rear line 56 secures to the rear left diagonal support 25. The canopy line connections align the right apex connection 28 and the left apex connection 29 to the canopy right upper support 44, and the canopy left upper support 45. The tension in the canopy front support 42, and the tension in the canopy rear support 43 can flex the canopy right upper support and the canopy left upper support to have a slight bow shaped profile as seen in FIG. 4 as the cord is pulled taught.

Figure 5:
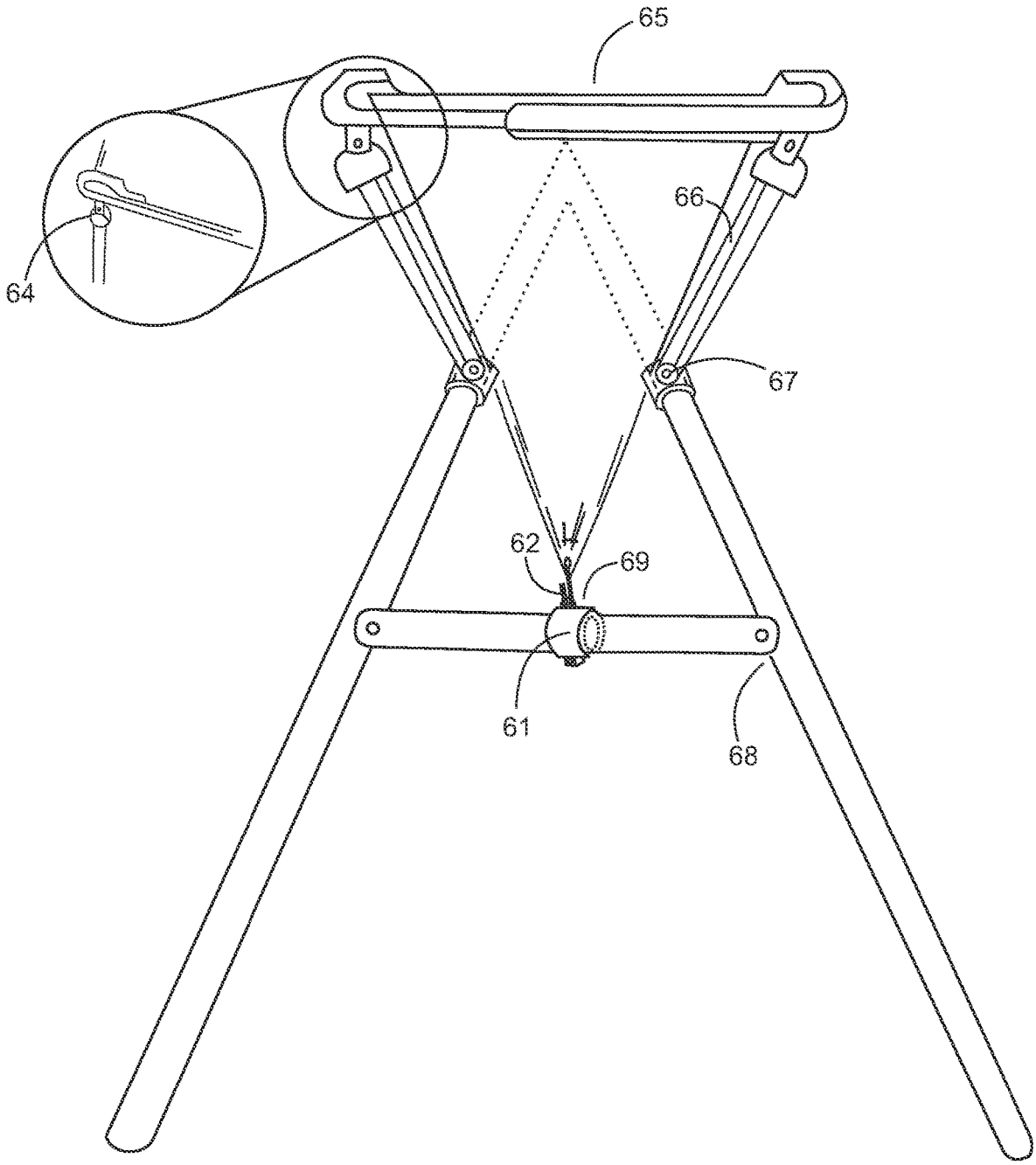
FIG. 5 is a detailed view of the present invention.

As seen in FIG. 5, upgraded connection hardware can improve connection for high wind speed situations which is a reinforced version of the main embodiment shown in FIGS. 2, 3. The upgraded hardware connection version has a pair of rigid retaining rods that clamp to the diagonal portion of the swingset frame instead of flexible fiberglass rods that form flexible a triangular frame. The upgraded connection hardware method is more like a canopy version and the flexible triangular frame method is more like a tent version. In the upgraded connection hardware version of FIG. 5, tools may be required for assembly.

Instead of a hook and loop tape strap, or a rope buckle, a collar connector 61 can be formed as a clamp that wraps around the right or left horizontal frame member. A hook connector 62 can connect the right or left tip of the canopy to the collar connector 61 at an eyelet formed on the collar connector 61. Additionally, an edge retainer hook 63 can retain the canopy at the canopy edge 59 if the interior pocket is insufficient to hold the fiberglass rod, such as in case of high wind. A swivel joint 64 can be made as a ball joint that secures the canopy edge 59. The ball joint can connect to a rotating rod 66 that mounts to the diagonal member also at a collar connector 61 formed as a clamp. The swivel joint 64 can be connected to a rigid rod as the canopy left front support 48, the canopy right front support 46, the canopy left rear support 49, or the canopy right rear support 47. The canopy right upper support 44 and the canopy left upper support 45 can be formed as a telescoping mechanism 65 instead of a simple fiberglass pole. The telescoping mechanism 65 can be a pair of fiberglass rods, or a metal rod inside a tube in telescopic connection.

A soldered ring 69 or a welded ring can form an eyelet that receives the hook connector 62. The collar preferably has a collar set screw 67 for bolting to the swingset frame. The frame bolt 68 bolts the horizontal frame member to the diagonal frame member. Thus, the present invention can be made as a lightweight flexible structure having only fiberglass rods, fabric and hook and loop tape straps. The present invention can also be made as a heavier structure using the upgraded connection hardware. The lightweight flexible structure is wind resistant because the hook and loop tape straps can detach from the swingset frame in high wind, and be reinstalled afterwards. The heavier structure resists the wind and may not need to be removed.

The invention claimed is:

1. A swingset frame shade comprising:

a. a canopy top, wherein the canopy top is bounded by and has a canopy front support, a canopy rear support, a canopy right upper support, and a canopy left upper support;

b. a right panel connected to the canopy top at the canopy right upper support;

c. a canopy right front support extending downwardly from the canopy right upper support and a canopy right rear support extending downwardly from the canopy right upper support, wherein the canopy right front support and the canopy right rear support join together at a right lower tip;

d. a left panel connected to the canopy top at the canopy left upper support;

e. a canopy left front support extending downwardly from the canopy left upper support and a canopy left rear support extending downwardly from the canopy left upper support, wherein the canopy left front support and the canopy left rear support join at a left lower tip; and f. a canopy left front line and a canopy left rear line, wherein the canopy left front line is connected to a left front canopy corner, wherein the canopy left front support connects to the canopy left upper support, wherein the canopy left rear line is connected to a left rear canopy corner where the canopy left upper support is connected to the canopy left rear support.

2. The swingset frame shade of claim 1, wherein the right panel is formed in a right panel triangular shape, wherein the canopy right front support, the canopy right rear support, and the canopy right upper support are formed as flexible rods arranged along edges of the right panel triangular shape, wherein the right lower tip, a right front canopy corner, and a right rear canopy corner form vertices of the right panel triangular shape.

3. The swingset frame shade of claim 2, wherein the right front canopy corner is connected to a canopy right front line, wherein the right rear canopy corner is connected to a canopy right rear line.

4. The swingset frame shade of claim 1, wherein the left panel is formed in a left panel triangular shape, wherein the canopy left front support, the canopy right left support, and the canopy left upper support are formed as flexible rods arranged along edges of the left panel triangular shape, wherein the left lower tip, the left front canopy corner, and the left rear canopy corner form vertices of the left panel triangular shape.

5. The swingset frame shade of claim 1, wherein the canopy top has a top right sleeve receiving the canopy right upper support, and wherein the canopy top has a top left sleeve receiving the canopy left upper support.

6. The swingset frame shade of claim 1, wherein the canopy right upper support is retained between a front right pocket formed at a right front canopy corner and a rear right pocket formed at a right rear canopy corner.

7. The swingset frame shade of claim 1, wherein the canopy left upper support is retained between a front left pocket formed at the left front canopy corner and a rear left pocket formed at the left rear canopy corner.

8. The swingset frame shade of claim 1, wherein the canopy top with the right panel and the left panel is mounted to a swingset frame, wherein the swingset frame further includes:

a. a top horizontal frame support, wherein the top horizontal frame support has a left apex connection and a right apex connection;

b. a front left diagonal support, and a rear left diagonal support, wherein the front left diagonal support and the rear left diagonal support connect together at the left apex connection;

c. a front right diagonal support and a rear right diagonal support, wherein the front right diagonal support and the rear right diagonal support connect together at the right apex connection;

d. a right horizontal support connecting between the front right diagonal support and the rear right diagonal support; and e. a left horizontal support, wherein the left horizontal support connects between the front left diagnosed support and the rear left diagonal support.

9. The swingset frame shade of claim 8, wherein the right panel is formed in a right panel triangular shape, wherein the canopy right front support, the canopy right rear support, and the canopy right upper support are formed as flexible rods arranged along edges of the right panel triangular shape, wherein the right lower tip, a right front canopy corner, and a right rear canopy corner form vertices of the right panel triangular shape.

10. The swingset frame shade of claim 9, wherein the right front canopy corner is connected to a canopy right front line, wherein the right rear canopy corner is connected to a canopy right rear line.

11. The swingset frame shade of claim 8, wherein the left panel is formed in a left panel triangular shape, wherein the canopy left front support, the canopy right left support, and the canopy left upper support are formed as flexible rods arranged along edges of the left panel triangular shape, wherein the left lower tip, the left front canopy corner, and the left rear canopy corner form vertices of the left panel triangular shape.

12. The swingset frame shade of claim 8, wherein the canopy top has a top right sleeve receiving the canopy right upper support, and wherein the canopy top has a top left sleeve receiving the canopy left upper support.

13. The swingset frame shade of claim 8, wherein the canopy right upper support is retained between a front right pocket formed at a right front canopy corner and a rear right pocket formed at a right rear canopy corner.

14. The swingset frame shade of claim 8, wherein the canopy left upper support is retained between a front left pocket formed at the left front canopy corner and a rear left pocket formed at the left rear canopy corner.

15. The swingset frame shade of claim 8, wherein the canopy right upper support and the canopy left upper support are formed as telescopic rods.

16. The swingset frame shade of claim 8, wherein the canopy left front line, the canopy left rear line, a canopy right front line, and a canopy right rear line are formed as rods.

* * * * *